US005268559A

United States Patent [19]

Jacobs

[11] Patent Number: 5,268,559

[45] Date of Patent: Dec. 7, 1993

[54] HIGH SPEED PICTORIAL COLOR BELT FUSER WITH STRAINING ELASTIC BELT

[75] Inventor: Robert M. Jacobs, Ontario, N.Y.

[73] Assignee: Xerox Corporation, Stamford, Conn.

[21] Appl. No.: 992,974

[22] Filed: Dec. 18, 1992

[51] Int. Cl.[5] ..... G03G 15/20

[52] U.S. Cl. ..... 219/216; 355/282; 355/285; 430/124

[58] Field of Search ..... 219/216; 355/282, 285, 355/289, 290; 430/124; 474/101

[56] References Cited

U.S. PATENT DOCUMENTS 3,811,828 5/1974 Ohta et al. ..... 219/216 X
4,132,882 1/1979 Endo et al. ..... 219/216
4,214,549 7/1980 Moser ..... 118/60
4,566,779 1/1986 Coli et al. ..... 355/212
5,162,634 11/1992 Kusaka et al. ..... 219/216

FOREIGN PATENT DOCUMENTS 411588 2/1991 European Pat. Off. ..... 355/290

*Primary Examiner*—Benjamin R. Fuller
*Assistant Examiner*—J. E. Barlow, Jr.

[57] ABSTRACT

A belt fuser which is self-stripping. The belt and a pressure roll form a nip through substrates carrying toner images pass with the toner images contacting the belt. The belt is entrained about a plurality of rollers for movement in an endless path. One of the rollers which is a drive roller for effecting belt movement is overdriven for causing a post-nip extent of the belt to stretch for effecting separation of the substrates from the belt.

7 Claims, 1 Drawing Sheet

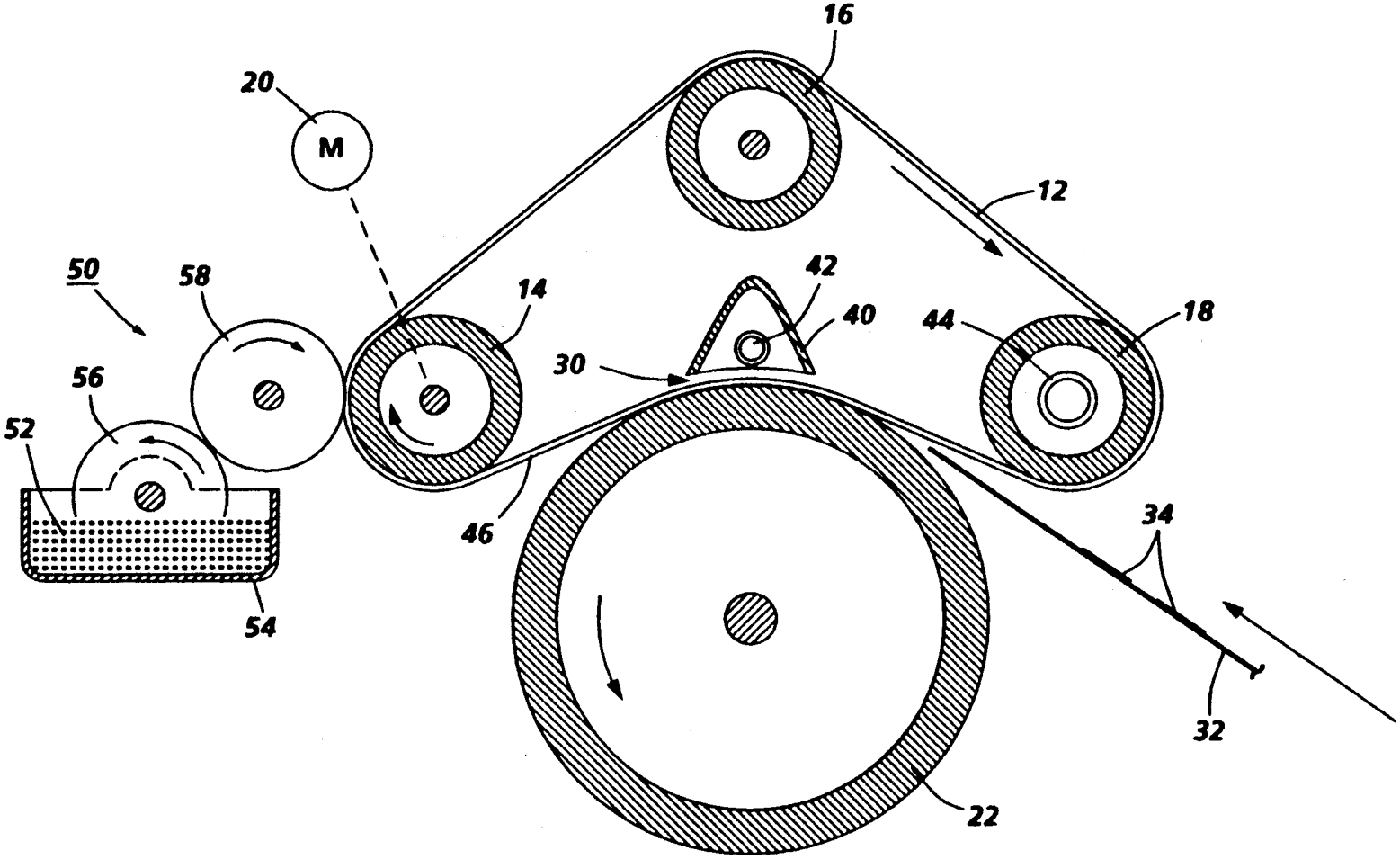
16
12
18
44
40
42
30
14
20
M
58
50
56
52
54
46
22
34
32

HIGH SPEED PICTORIAL COLOR BELT FUSER WITH STRAINING ELASTIC BELT

BACKGROUND OF THE INVENTION

The present invention relates to fuser apparatus for electrostatographic printing machines and in particular to devices and methods for fixing or fusing pictorial color images.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an abhesive material, such as a silicone rubber or other low surface energy material, for example, tetrafluoroethylene resin sold by E. I. DuPont De Nemours under the trademark Teflon.

Roll fusers are known to be capable of fusing monochrome black toner images at very high (i.e. 135 cpm) speeds. However, roll fusers capable of fusing pictorial images at relatively high speeds are non existent. Currently, the highest speed pictorial color fuser commercially available is capable of only fusing at 23 copies per minute (cpm).

BRIEF SUMMARY OF THE INVENTION

Briefly, the present invention provides fusing of pictorial color toner images at relatively high speeds.

The fusing of pictorial colored images to an attractive gloss in xerography requires extended dwell time at fusing temperatures, fuser rubber strain and fuser roll or belt smoothness or surface gloss. The extended dwell ensures complete toner flow. The rubber strain ensures release and stripping. The roll or belt contacting the toner images on the substrate imparts its smoothness to the image to produce image gloss.

One of the most difficult problems in the development of a pictorial color fuser is that of achieving stripping.

In a heat and pressure roll fuser, stripping of the image substrate is effected by using stripping devices such as fingers or blades in conjunction with hard surfaced fuser rolls or by constructing the fuser roll member contacting the toner images such that the system is self-stripping. In the latter case, the the fuser roll is usually fabricated from a relatively thick deformable material such as silicone rubber.

Belt fusers, in particular, one that is heated from the backside, are constructed using relatively thin elastomeric material. Thin belt fusers are less compatible with devices such as stripper fingers or blades and they do not lend themselves to self-stripping due to straining in the nip as are some roll fusers.

The present invention provides a belt fuser which is self-stripping. To this end, a belt comprising the member contacting the toner images to be fixed is entrained about a plurality of rolls including a drive roll for imparting movement to the belt. A hard pressure roll cooperates with the belt to form a nip through which copy substrates pass with the toner images thereon contacting the heated belt. The drive roll is overdriven such that the post-nip extent of the belt becomes stretched thereby effecting stripping of the substrate from the belt.

The self-stripping action of the fuser of the present invention is similar to the phenomena that takes place when scotch tape is adhered to a rubber band and then rubber band is stretched. The tape will pop off of the rubber band. In this fuser the tape is the paper with molten toner and the rubber band is the elastic belt that is stretched. The stretching of the belt at the nip exit ensures that the toner will not adhere to the fuser belt.

BRIEF DESCRIPTION OF THE DRAWINGS

The FIGURE is a schematic side elevational view of a fuser according the invention.

DESCRIPTION OF THE PREFERRED EMBODIMENT

Attention is now directed to the FIGURE wherein a heat and pressure fuser apparatus and release agent management system therefor are schematically illustrated. As shown in the FIGURE, the fuser apparatus 10 comprises a heated fuser belt member 12. The belt may be fabricated from an elastomeric material such as silicone rubber or Viton TM. The belt thickness is on the order of 10 mils and preferably has a relatively smooth. surface. A suitable degree of smoothness insures the desired image gloss for fusing spot on spot color images as opposed to spot next to spot images.

The belt member 12 is entrained about a plurality of rollers 14, 16 and 18 for movement in an endless path.

To this end, a motor 20 and a drive mechanism (not shown) are provided for effecting movement of the belt in the clockwise direction as viewed in the FIGURE.

A relatively rigid pressure roll 22 is supported for rotation through movement of the belt by virtue of the friction therebetween. The pressure roll and the belt member form a nip 30 through substrates 32 carrying relatively thick toner images represented by reference character 34 pass with the toner images contacting the smooth surface of the belt member.

A radiant heating arrangement comprising a reflector 40 and a quartz heating element 42 are provided for heating the belt in the nip. While the radiant quartz lamp is shown as being positioned adjacent the middle of the nip 30 it will be appreciated that it may other positions relative to the nip. Another heating member 44 disposed internally of the idler roller 18 serves to preheat the belt prior to its passing through the nip.

The pressure roll 22 is rotated by the belt member 12. The pressure roll resists movement by the belt member due to the friction therebetween. The roller 14 is overdriven by the motor 20 to cause the post-nip extent 46 of the belt member to elongate for effecting separation of the toner image carrying substrates from the belt. By overdriven is meant that the drive roller is driven faster than the friction between the fuser belt and the pressure roll allows the belt to be driven without stretching of the post-nip extent 46 of the belt 12. A friction retard roll (not shown) could be utilized in conjunction with or in lieu of the pressure roll for effecting resistance to belt movement for causing belt stretching. The retard roll could be positioned in contact with the inner surface of the belt in a area adjacent the support roller 14.

A liquid release agent management (RAM) or delivery system 50 is provided for applying a release agent material such as silicone oil 52 contained in a sump 54. The silicone oil is applied to the surface of the fuser belt member 12 via a metering roll 56 and a donor roll 58, the former of which is partially submersed in the silicone oil and contacts the latter for delivering silicone oil thereto. In the prior art the metering roll contacts the fuser roll 12 as illustrated in the FIGURE for applying a thin coating of silicone oil thereto for preventing offset of toner forming toner images 34 carried by the paper substrate 32. For a more detailed description of the release agent management system reference may be had to U.S. Pat. No. 4,214,549 granted to Rabin Moser on Jul. 29, 1980 which patent is incorporated herein by reference.

The liquid release agent may be selected from those materials which have been conventionally used. Typical release agents include a variety of conventionally used silicone oils including both functional and nonfunctional oils. Thus, the release agent is selected to be compatible with the rest of the system.

What is claimed is:

1. Image fixing apparatus, said apparatus comprising:

a resilient belt fuser member;

a pressure roll cooperating with said belt fuser member to form a nip through which copy substrates pass with toner images carried thereby contacting said belt fuser member, said nip having an entrance and an exit;

means for elevating the temperature of said belt fuser member;

means supporting said resilient belt fuser member for movement in an endless path;

means for effecting movement of said resilient belt fuser member in an endless path; and means for causing said belt fuser member to be self-stripping whereby said substrates are separated from said resilient belt fuser member, said means for causing said belt fuser member to be self-stripping comprising means for effecting stretching a portion of said belt member adjacent said exit.

2. Apparatus according to claim 1 wherein said means for causing said belt fuser member to be self-stripping comprises means for resisting belt moment cooperating with said means for effecting movement of said resilient belt fuser member.

3. Apparatus according to claim 2 wherein said means for resisting belt movement comprises said pressure roll cooperating with said means for effecting movement of said resilient belt fuser member.

4. Apparatus according to claim 2 wherein said means for effecting movement of said resilient belt member comprises means for overdriving said belt fuser member.

5. Method of fixing toner images, said method including the steps of:

moving a resilient belt fuser member in an endless path;

supporting a pressure roll for engagement with said belt fuser member to form a nip through which copy substrates pass with toner images carried thereby contacting said belt fuser member, said nip having an entrance and an exit;

elevating the temperature of said belt fuser member; and causing said belt fuser member to be self-stripping by stretching a portion of said belt fuser member adjacent said exit whereby said substrates are separated from said resilient belt fuser member.

6. The method according to claim 5 wherein said step for causing said belt fuser member to be self-stripping comprises causing said belt fuser member to resist moment in said nip.

7. The method according to claim 6 wherein said step for effecting movement of said resilient belt fuser member further includes overdriving said belt fuser member.

* * * * *